US005714992A

United States Patent [19]

Desie

[11] Patent Number: 5,714,992

[45] Date of Patent: Feb. 3, 1998

[54] PRINTHEAD STRUCTURE FOR USE IN A DEP DEVICE

[75] Inventor: Guido Desie, Mortsel, Belgium

[73] Assignee: Agfa-Gevaert, N.V., Mortsel, Belgium

[21] Appl. No.: 679,847

[22] Filed: Jul. 15, 1996

[30] Foreign Application Priority Data

Jul. 18, 1995 [EP] European Pat. Off. ..... 95201972

[51] Int. Cl.[6] ..... B41J 2/415

[52] U.S. Cl. ..... 347/55; 347/158

[58] Field of Search ..... 347/55, 123, 124, 347/151, 158

[56] References Cited

U.S. PATENT DOCUMENTS

| | | | |
|---|---|---|---|
| 5,121,144 | 6/1992 | Larson et al. . | |
| 5,204,696 | 4/1993 | Schmidlin et al. . | |
| 5,404,159 | 4/1995 | Ohashi . | |
| 5,481,286 | 1/1996 | Kagayama | 347/55 |

FOREIGN PATENT DOCUMENTS

| | | | |
|---|---|---|---|
| 0587366 | 3/1994 | European Pat. Off. . | |
| 6-246958 | 9/1994 | Japan | 347/55 |

*Primary Examiner*—Joan H. Pendegrass

*Attorney, Agent, or Firm*—Brumbaugh, Graves, Donohue, & Raymond

[57] ABSTRACT

A printhead structure (106) for use in a DEP (Direct Electrostatic Printing) device is provided, made from an insulating material comprising control electrodes in combination with printing apertures, characterized in that:

(i) the printhead structure comprises individual control electrodes (106*a*), each of the individual control electrodes being combined with at least one aperture (107), on one side of the printhead structure, (ii) each of the individual control electrodes (106*a*) is located on the same side of the insulating material and (iii) the apertures are rectangles with an aspect ratio (AR), defined as the ratio of the width of the apertures in their long axis (WL) over the width of the apertures in a direction perpendicular to this long axis (WD), larger than 1. In a preferred embodiment each single control electrode controls two printing apertures with AR>1 and these two apertures are separated by a portion of the control electrode controlling them.

10 Claims, 2 Drawing Sheets

PRINTHEAD STRUCTURE FOR USE IN A DEP DEVICE

FIELD OF THE INVENTION

This invention relates to a printhead structure useful in an apparatus used in the process of electrostatic printing and more particularly in Direct Electrostatic Printing (DEP). In DEP, electrostatic printing is performed directly from a toner delivery means on a receiving member substrate by means of an electronically addressable printhead structure and the toner has to fly in an imagewise manner towards the receiving member substrate.

BACKGROUND OF THE INVENTION

In DEP (Direct Electrostatic Printing) the toner or developing material is deposited directly in an imagewise way on a receiving member substrate, the latter not bearing any imagewise latent electrostatic image. Preferentially the receiving member substrate is the final receiving member substrate, e.g. plain paper, transparency, etc. so that after this deposition step only a final fusing step is needed to finish the printout. However, the substrate can also be an intermediate endless flexible belt (e.g. aluminium, polyimide, etc.). In that case the imagewise deposited toner must be transferred onto another final substrate.

This makes the method different from classical electrography, in which a latent electrostatic image on a charge retentive surface is developed by a suitable material to make the latent image visible. Either the powder image is fused directly to said charge retentive surface, which then results in a direct electrographic print, or the powder image is transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

A DEP device is disclosed by Pressman in U.S. Pat. No. 3,689,935. This document discloses an electrostatic line printer having a multi-layered particle modulator or printhead structure comprising:

- a layer of insulating material, called isolation layer;
- a shield electrode consisting of a continuous layer of conductive material on one side of the isolation layer;
- a plurality of control electrodes formed by a segmented layer of conductive material on the other side of the isolation layer; and
- at least one row of apertures.

Hereinafter this printhead structure is referred to as a "classical" printhead.

Each control electrode is formed around one aperture and is isolated from each other control electrode.

Selected potentials are applied to each of the control electrodes while a fixed potential is applied to the shield electrode. An overall applied propulsion field between a toner delivery means and a receiving member support projects charged toner particles through a row of apertures of the printhead structure. The intensity of the particle stream is modulated according to the pattern of potentials applied to the control electrodes. The modulated stream of charged particles impinges upon a receiving member substrate, interposed in the modulated particle stream. The receiving member substrate is transported in a direction perpendicular to the printhead structure, to provide a line-by-line scan printing. The shield electrode may face the toner delivery means and the control electrode may face the receiving member substrate. A DC field is applied between the printhead structure and a single back electrode on the receiving member support. This propulsion field is responsible for the attraction of toner to the receiving member substrate that is placed between the printhead structure and the back electrode.

This kind of printing engine, however, requires a rather high voltage source and expensive electronics for changing the overall density between maximum and minimum density, making the apparatus complex and expensive. Further on, by changing the voltage value applied to the control electrodes, the resulting density on the receiving member is changed. Higher blocking voltages result in lower densities but also in smaller dots, leading to differences in image evenness as a function of density.

To overcome these problems several modifications have been proposed in the literature.

In U.S. Pat. No. 4,912,489 the conventional positional order of shield electrode and the control electrode—as described by Pressman—has been reversed. This results in lower voltages needed for tuning the printing density. In a preferred embodiment, this patent discloses a new printhead structure in which the toner particles from the toner delivery means first enter the printhead structure via larger apertures, surrounded by so-called screening electrodes, further pass via smaller apertures, surrounded by control electrodes and leave the structure via a shield electrode. The larger aperture diameter is advised in order to overcome problems concerning crosstalk.

In EP-A-0 587 366 an apparatus is described in which the distance between printhead structure and toner delivery means is made very small by using a scratching contact. As a result, the voltage—needed to overcome the applied propulsion field—is very small. The scratching contact, however, strongly demands a very abrasion resistant top layer on the printhead structure.

An apparatus working at very close distance between the printhead structure and the toner delivery means is also described in U.S. Pat. No. 5,281,982. Here a fixed but very small gap is created in a rigid configuration, making it possible to use a rather low voltage to select wanted packets of toner particles. However, the rigid configuration requires special electrodes in the printhead structure and circuits to provide toner migration via travelling waves.

In U.S. Pat. No. 5,402,158 a printhead structure with only one layer of segmented control electrodes without shield electrodes is described. Since the control electrodes can be placed at closer distances from the toner application module, density modulation with smaller voltages becomes also possible.

According to U.S. Pat. No. 4,491,855 the image density can also be enhanced by the introduction of an AC-voltage, applied to the toner conveying member. As a result, shorter writing times are possible. But, to obtain a reduced image density, the same or higher voltage levels as compared to the voltage levels needed with a "classical" printhead must be applied.

In U.S. Pat. No. 5,404,159 it is disclosed to use elliptical or oval printing apertures, wherein each single aperture is surrounded by a control electrode. The printing direction, i.e. the movement of the paper on which the printing proceeds, is perpendicular to the longer axis of the ellipse. The disclosure claims that elliptical apertures are superior to circular apertures in giving high resolution.

All above mentioned patent applications just fulfil part of the different requirements for an inexpensive DEP device, delivering high-quality images with inexpensive driving electronics.

There is thus still a need to have a DEP system, based on a simple inexpensive apparatus, yielding high quality images in a reproducible and constant way without differences in image evenness as a function of printing density.

OBJECTS OF THE INVENTION

It is an object of the invention to provide a printhead structure useful in a Direct Electrostatic Printing (DEP) device, that makes it possible to print with a lower voltage and with substantially reduced density fluctuations (banding) in even density areas.

It is a further object of the invention to provide a printhead structure that makes it possible to print an even image quality, with strongly reduced density fluctuations (banding), irrespective of the image density.

It is a further object of the invention to provide a printhead for a DEP device, making it possible to print lines, the width of which is not, or only to a lower extent, changed as a function of the optical density level of that line.

It is an other object of the invention to provide an improved DEP device, incorporating an improved printhead structure, that is capable of printing even density areas without density fluctuations and that at the same time can be manufactured in an economically sound way.

Further objects and advantages of the invention will become clear from the description hereinafter.

The above objects are realized by providing a printhead structure (106) for use in a DEP (Direct Electrostatic Printing) device, made from an insulating material comprising control electrodes in combination with printing apertures, characterised in that (i) said printhead structure comprises individual control electrodes (106*a*), each of said individual control electrodes being combined with at least one aperture (107), (ii) each of said individual control electrodes (106*a*) is located on one side of said insulating material and (iii) said apertures are rectangular, having a long axis WL and a short axis WD, and an aspect ratio (AR), defined as AR=WL/WD, wherein AR is larger than 1.

DETAILED DESCRIPTION OF THE INVENTION

In the literature many devices have been described that operate according to the principles of DEP (Direct Electrographic Printing).

DEP devices are quite well suitable for poster printing at moderate resolution, i.e. a resolution equal to or lower than 100 dpi (40 dots/cm). In that case printing apertures with relatively large diameters can be used. This leads to printers with high printing speeds and easy control over clogging of the individual apertures. However, apertures with a large diameter also require a very high voltage source in order to be able to block the toner flux passing through said apertures, leading to reduced or even zero density. The control voltage can be reduced as described in the literature by placing the control electrodes at close distance from the toner application module, but with apertures with a very large diameter it is impossible to stop the toner flux completely. Therefore the need for modifications to the prior art printhead structures, in order to be able to operate large apertures with low control voltages is real.

In poster printing large areas of even density, at various density levels, have frequently to be reproduced. Most if not all prior art printhead structures control the density delivered by a printing apertures not only by changes in density, but also by changing the individual dot size. Since the human eye is very sensitive to small (recurring) density fluctuations in even density areas of images, said dot size change is easily observed. And the density fluctuations in an even density area appear as a kind of banding. These density fluctuations are observable both in image regions of full density and in image regions of reduced image density. Therefore not only a printhead structure operating at low control voltages is needed, but also a printhead structure allowing to print at high speed, with low operating voltages and avoiding density fluctuations in even density areas.

When printing lines, in a DEP device, it is mostly seen that the line width is lowered when the optical density of the line is lowered. I.e. when a 100 μm wide line, extending in the printing direction (i.e. the direction of movement of the substrate on which is printed) is printed at maximum optical density, the printed line has an actual printed width of 100 μm, when the same 100 μm wide line is printed a, e.g. 25% of the maximum optical density, the actual result on the substrate is a line of only 30 to 50 μm wide. Thus the reproduction quality (fidelity) in a direction perpendicular to the printing direction leaves room for improvement.

Figure 1:
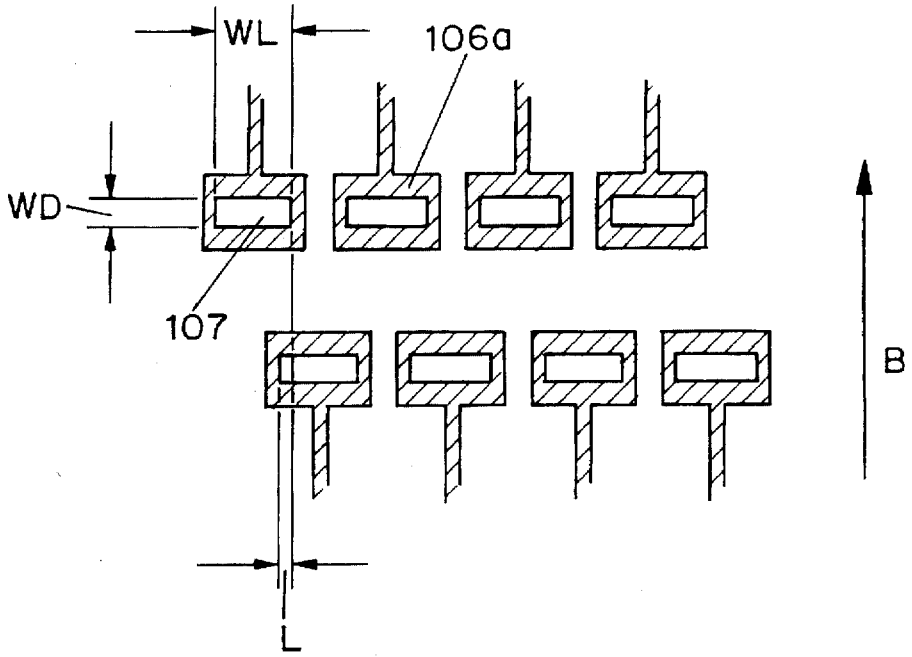
FIG. 1 is a schematic illustration of a possible embodiment of a printhead structure according to the present invention, showing rectangular printing apertures (107).

It was found that the above indicated problems could be solved by using the printhead structure of the present invention. Said printhead structure according to the present invention comprises an insulating film with at least one row of segmented conducting electrodes and having apertures through both conductive and isolating layers, wherein said apertures are rectangular. It is preferred that the printing direction (i.e. the movement of the substrate receiving the image) is perpendicular to the longest sides of the rectangle. The use of rectangular printing apertures yielded better results than the use of circular apertures and yielded even slightly better results than e.g. elliptical apertures. In FIG. 1 the electrode configuration on a first embodiment of a printhead structure, according to the present invention, is shown. In this figure control electrodes (106*a*) surround rectangular printing apertures (107). The printing apertures are characterised with a long axis WL and a short axis, WD, perpendicular to said long axis and an aspect ratio (AR) defined as WL/WD, which is larger than 1. In the FIG. 1 the apertures (107) are staggered in two rows (it is possible to implement a printhead structure according to the present invention with several rows of apertures having AR>1) and the apertures on consecutive rows overlap each other for a distance L. Arrow B indicates the printing direction. In a printhead structure according to the present invention, AR is always greater than 1. The distance L (degree of overlap) may be zero, but preferably an overlap of at least 20% of the width of the apertures in their long axis (WL) is present, i.e. $L \geqq 0.20$ WL.

In a second embodiment of the present invention, each control electrode was used to control at least two printing apertures with AR>1 (AR is the aspect ratio, defined as the ratio of the long axis WL of said apertures over the short axis, WD, of said apertures, perpendicular to this long axis, and the printing direction was perpendicular to the long axis. It was found that the advantages of using a printhead structure according to the present invention were even more pronounced by using a printhead structure according to said second embodiment of this invention. When at least two apertures are controlled by one control electrode, a portion of the control electrode separates two adjacent apertures. Thus a printhead structure according to the second embodiment of the present invention is characterised in that:

(i) said printhead structure comprises individual control electrodes (106*a*), each of said individual control electrodes controlling a plurality of i apertures (107), i being an integer larger than 1, (ii) each of said individual control electrodes (106*a*) is located on one side of said insulating material and (iii) each of said i apertures having a long axis $WL_j$ (j=1 . . . i) and a short axis $WD_j$ (j=1 . . . i) and an aspect ratio (AR), defined as $WL_j/WD_j$, larger than 1 and i−1 portions of said control electrode, having width $WE_k$ (k=1 . . . (i−1)), separate each of said apertures (107).

The sum of the dimension WD of all printing apertures controlled by said single electrode and the sum of the smallest lengths of each of said portions of the control electrode, separating the apertures and measured in a direction perpendicular to the long axis of the printing apertures, is preferably equal to or lower than 1.20 times the largest of the long axis WL of said apertures. Thus in a printhead structure wherein each single control electrode controls at least two apertures, the formula $$\left(\sum_{j=1}^{i} WD_j + \sum_{k=1}^{(i-1)} WE_k\right) \leqq 1.20WL_{max},$$

wherein $WL_{max}$ is the largest of said dimensions $WL_j$, is fulfilled. More preferably, in such a printhead structure, the formula $$1.00WL_{max} \leqq \left(\sum_{j=1}^{i} WD_j + \sum_{k=1}^{(i-1)} WE_k\right) \leqq 1.20WL_{max},$$

wherein $WL_{max}$ is the largest of said dimensions $WL_j$, is fulfilled.

In a further preferred embodiment, in a printhead structure according to this invention, wherein a single control electrode controls a plurality of printing apertures, the formula $$\left(\sum_{j=1}^{i} WD_j + \sum_{k=1}^{(i-1)} WE_k\right) = 1.00WL_{max},$$

wherein $WL_{max}$ is the largest of said dimensions $WL_j$, is fulfilled.

Figure 2:
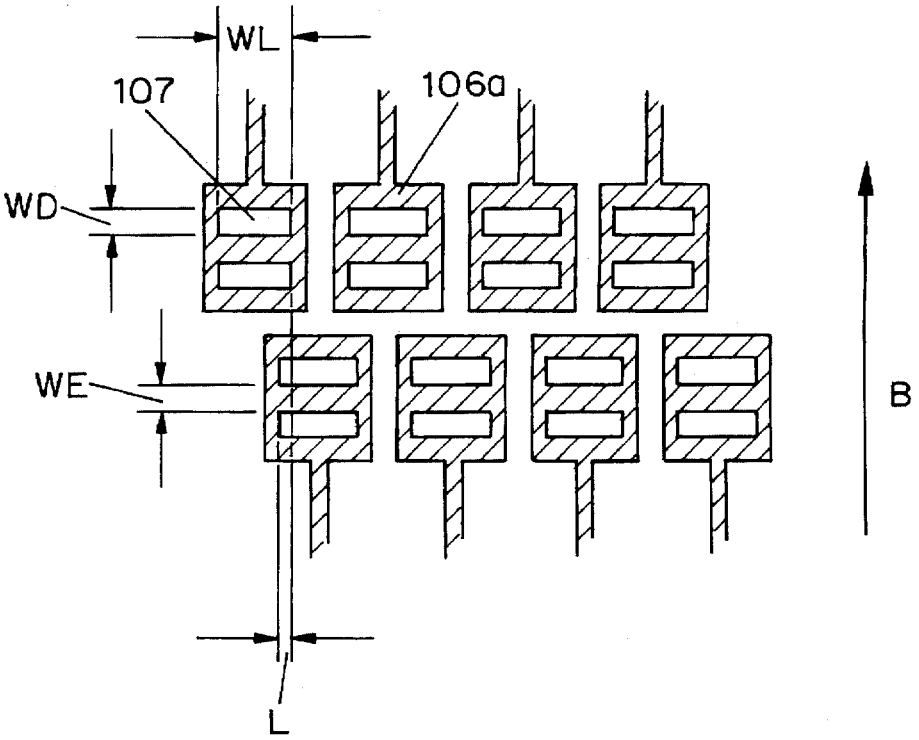
FIG. 2 is a schematic illustration of an other possible embodiment of a printhead structure according to the present invention, showing rectangular printing apertures (107).

It has been found that still better printing results (higher speed, lower voltage and more even density areas of equal density) could be reached with a printhead structure according to a specific implementation of said second embodiment of this invention when the value of i is 2. This specific implementation is shown in FIG. 2. The individual electrode (106*a*) surrounds two apertures (107), both with an aspect ratio AR>1. In FIG. 2, WL indicates again the long axis of the apertures and WD the short axis. Arrow B indicates the printing direction (i.e. the direction of movement of the image receiving substrate). Since in this case the number i of apertures is 2 and the number of portions of the control electrode separating the two apertures is 1, it can been seen, by inserting these value in the formulas above, that it is preferred for the specific embodiment of the invention shown in FIG. 2 that (2 WD+WE)≦1.20 WL, that it is more preferred that 1.0 WL≦(2 WD+WE)≦1.20 WL and that it is further preferred that (2 WD+WE)=WL. In the second embodiment of the invention, embodiment shown in figure two it is preferred that both apertures have the same dimensions (WD and WL) and that the smallest of said widths $WE_k$ of said portions of said control electrode separating said apertures (107) is equal to or larger than half the width of the longest of said short axis $WD_j$.

Thus, by constructing a printhead structure with rectangular apertures, individual control electrodes controlling more than one of said rectangular apertures, it is possible to have in the print a substantially square dot, printed by two or more rectangular apertures that can be controlled by lower voltages.

The apertures FIG. 2 are shown as rectangles, which is a preferred implementation of this embodiment of the invention, but the apertures can also be ellipses, ovals etc . . . , as long as AR>1 and a single control electrode controls two of said apertures. When the apertures are ellipses, the long axis WL is the long axis of the ellipse and the short axis WD is the short axis of the ellipse. In a printhead structure according this specific implementation of the second embodiment of this invention, each of the control electrodes present on the printhead structure controls two apertures.

Also in the embodiment, shown in FIG. 2 the apertures (107) are staggered in different rows and the apertures on consecutive rows overlap each other for a distance L. The distance L (degree of overlap) may be zero, but preferably an overlap of at least 20% of the width of the apertures in their long axis (WL) is present, i.e. L≧0.20 WL.

The overlap (distance L), between a certain number of apertures, in a printhead structure according to this invention, can even be 100% or L=WL.

When using such an overlap it is preferable that a printhead structure is used with two or more sets of rows of apertures. A possible embodiment of a printhead structure, comprising more than one set of rows is given immediately below. In both sets of rows the apertures can overlap with a distance L smaller than 100%, i.e. L<WL or even without overlap, but both sets overlap row by row for 100%. E.g. a printhead structure can comprise two sets of apertures, each set having four rows of apertures (RA1 to RA4 for the first set, RA'1 to RA'4 for the second set). In each set each consecutive pair of rows the apertures overlap for less than 100%. I.e. RA2 overlaps 20% with RA1, RA3 overlaps 20% with RA2, etc. The apertures in each row in one set overlap for 100% with the apertures in the corresponding row of the other set, i.e. RA'1 overlaps RA1 for 100%, RA'2 overlaps RA2 for 100%, etc.

The advantage of a printhead structure, described immediately above lays in the redundancy. With such a printhead structure it is possible to print each dot at least twice, so that when one electrode would malfunction, the dot, addressed by that electrode is still printed by the second set of rows of apertures. The redundancy is described herein in combination with apertures having an aspect ratio AR>1, but the advantages of redundancy are achieved with any printhead structure, having printing apertures of any shape, as long as it carries more than one set of rows of apertures.

In FIGS. 1 and 2 the apertures shown have all the same dimensions (i.e. WL and WD are equal for all apertures) and the aspect ratio of each aperture is the same and greater than 1. It is possible to implement a printhead structure, according to the present invention, wherein the dimensions of the apertures are not equal, and/or where not all of the apertures fulfil the relation aspect ratio AR>1. In some circumstances it can be beneficial to use a printhead structure combining rows of apertures wherein, in each row the apertures are equal, but wherein the dimensions of the apertures change from row to row, but wherein all apertures have an aspect ratio greater than 1. The use of such a printhead structure can help to fine tune the printing resolution, edge sharpness and evenness of areas of equal density.

According to one aspect of the present invention the long-axis (WL) of said aperture is perpendicular to the printing direction, resulting in a line-thickness in the printing direction that is not sensitive to the image density.

Although the invention is described in connection with printhead structures wherein a single (individual) control electrode controls either a single aperture or a pair of apertures with aspect ratio AR>1, the individual control electrode may each control more than two apertures. The present invention therefore encompasses also printhead structures wherein each individual control electrode surrounds at least two apertures (107), both with an aspect ratio AR>1 and portion of said control electrode separates said apertures (107).

A printhead structure according to the present invention, comprising printing apertures with AR>1, can be implemented in several forms. It can comprise only control electrodes (106*a*) around the apertures, it can comprise also a shield electrode common to all printing apertures at the side of the insulating material opposite to the side carrying the control electrodes. In both cases the printhead structure can be installed between a toner delivery means and an image receiving member either with the control electrodes facing the toner delivery means or with the control electrodes facing the image receiving member. Printhead structures, according to the present invention, comprising printing apertures, having an aspect ratio AR>1, can also be made having individual control electrodes and individual shield electrodes. In that case the individual control and shield electrodes can be short-circuited through the printing apertures by e.g. metallization. In this case a printhead structure wherein each single electrode of said individual control electrodes (106*a*) and each single electrode of said individual shield electrodes arranged around each aperture (107) are connected to each other via metallisation through said single aperture (107), forming a single printing electrode around each aperture (107), is obtained.

It has proven to be beneficial in terms of long term stability when, in a printhead structure according to the present invention, that control electrodes (106*a*) are surface-treated with very thin abhesive coatings such as very thin coatings of TEFLON (trade name of Du Pont USA, polysiloxane resins, acrylic resins or epoxy resins. Also the use of thin very-hard layers (layers with very low scratchability), e.g. coatings of silicon carbide or nitride, or the like, is very useful. If necessary both kinds of layers can be present together.

The invention encompasses also a method for Direct Electrostatic Printing (DEP) comprising the steps of:

i) creating a flow of charged toner particles in an electrical field from a toner delivery means to a substrate, ii) image wise modulating said flow of charged toner particles by a printhead structure comprising printing apertures and control electrodes, said apertures being rectangular having a long axis WL and a short axis WD, and an aspect ratio (AR), defined as AR=WL/WD, wherein AR is larger than 1, iii) establishing a relative motion between said substrate and said printhead structure in a direction perpendicular to said long axis WL of said printing apertures, iv) image wise depositing toner particles, from said image wise modulated flow of charged toner particles, on said substrate and v) fixing said toner particles to said substrate.

The invention also provides a DEP device comprising a printhead structure as described herein above.

The invention further provides a DEP device (a device for direct electrostatic printing) comprising:

(i) means for providing an electrical field wherein a flow of charged toner particles from a toner delivery means (101) to a substrate (109) can be created, (ii) means for image wise modulating said flow of toner particles and image wise depositing said toner particles on said substrate which means comprise, a) a printhead structure installed between said toner delivery means (101) and said substrate (109), and comprising individual control electrodes (106*a*), each of said individual control electrodes being combined with at least one aperture (107), on one side of the printhead structure, each of said individual control electrodes (106*a*) being located on the same side of said insulating material and said apertures having a long axis WL and a short axis WD, and an aspect ratio (AR), defined as AR=WL/WD, wherein AR is larger than 1 and, b) a voltage source for applying a variable voltage on said control electrodes (V3)

iii) means for establishing a relative movement between said substrate and said printhead structure in a direction perpendicular to said long axis WL of said apertures, and iv) means for fixing said image wise deposited toner particles to said substrate.

In a preferred embodiment of a DEP device according to the present invention, said means for providing an electrical field wherein a flow of charged toner particles from a toner delivery means (101) to a substrate (109) can be created, comprise a back electrode (105) and voltage sources (V1, V2 and V4 in FIG. 3) which makes it possible to create a DC potential difference between said toner delivery means (101), a charged toner conveyer and said back electrode (105).

The printhead structure (106) according to the present invention, can be installed between a toner delivery means (101) and an image receiving member (109) either with the control electrodes facing the toner delivery means or with the control electrodes facing the image receiving member. In a preferred embodiment said printhead structure is installed between said toner delivery means (101) and said image receiving substrate (109), so that said control electrodes face said toner delivery means.

When using a printhead structure, according to the present invention, in a DEP device, it is preferred that the printing direction is perpendicular to the width of said aperture in its long axis (WL).

Description of a DEP device

A device for implementing DEP according to one embodiment of the present invention comprises (FIG. 3):

(i) a toner delivery means (101), comprising a container for multi component developer (102), comprising magnetic carrier particles and toner particles, and a magnetic brush assembly (104), this magnetic brush assembly forming a layer of charged toner particles upon the surface of a CTC (charged toner conveyor) (103), (ii) a receiving member support (105), for guiding the receiving member substrate (109) at a close distance from the printhead structure (106), according to the present invention, (iii) conveyer means (108) to convey a member receptive for said toner image—called receiving member substrate (109)—between a printhead structure (106) and said receiving member support (105) in the direction indicated by arrow A.

(iv) means for fixing (110) said toner onto said image receiving member substrate (109).

(v) a printhead structure (106), made from a plastic insulating film.

A specific embodiment of the present invention is made from single side coated polyimide isolating film. First of all the apertures are made in the copper electrodes via copper etching techniques and then apertures are also made through said isolating member by excimer laser burning or plasma etching. Then the control electrodes and connecting lines are made via copper etching techniques well known to those skilled in the art. The individual control electrodes (106*a*) are connected to a voltage source. In the embodiment shown in FIG. 3, a printhead structure comprising only control electrodes on one side of the printhead structure is shown, it is however also possible to implement a DEP device with a printhead structure according to the present invention wherein a shield electrode is possible on the face of the printhead structure opposite to the face carrying the control electrodes.

Figure 3:
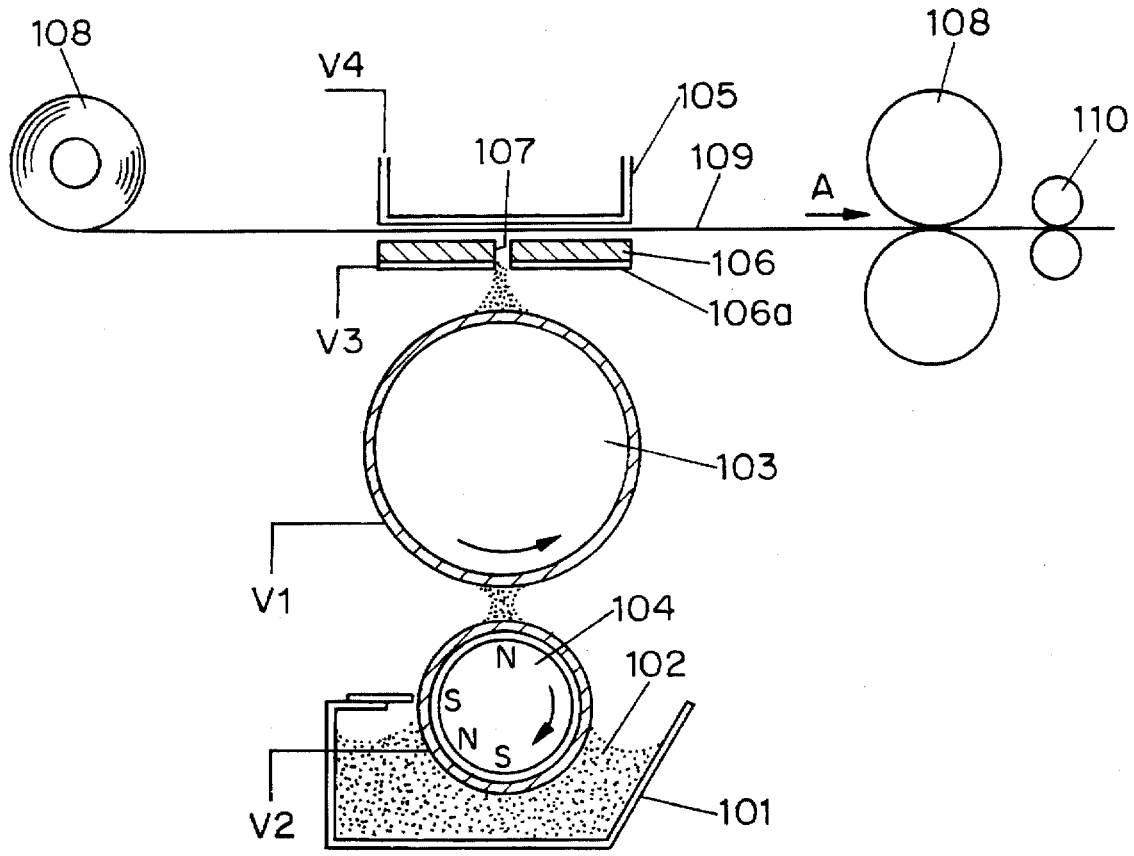
FIG. 3 is a schematic illustration of a possible embodiment of a DEP device according to the present invention.

Although in FIG. 3 a preferred embodiment of a DEP device is shown, it is possible to realise a DEP device according to the present invention using different constructions of the printhead structure (106). For instance, the apertures in these printhead structures can have an entry and exit openings that are equal in form and dimensions, or can have an entry opening larger than the exit opening or vice versa. It is also possible to place the control electrodes on the receiving member side, or to use printhead structures with more than one electrode plane: e.g. printhead structures with 2 or 3 conducting layers.

Different electrical fields can be created between the magnetic brush assembly (104), charged toner conveyor (103), control electrodes (106*a*) and the receiving member support (105), if this is coated by a metallic film too.

In a specific embodiment of a DEP device, according to the present invention, shown in FIG. 1, voltage $V_1$ is applied to the sleeve of the charged toner conveyor (103), voltage $V_2$ is applied to the sleeve of the magnetic brush (104), a voltage $V_3$, ranging from $V_{30}$ up to $V_{3n}$ to the individual control electrodes (106*a*), and voltage $V_4$ is applied to the receiving member support behind the toner receiving member.

Herein is $V_{30}$ the lowest voltage level applied to the control electrode, and $V_{3n}$ the highest voltage applied to said electrode. Usually a selected set of discrete voltage levels $V_{30}$, $V_{31}$, . . . can be applied to the control electrode. The value of the variable voltage $V_3$ is selected between the values $V_{30}$ and $V_{3n}$ from the set, according to the digital value of the image forming signals, representing the desired grey levels. Alternatively, the voltage can be modulated on a time basis according to the grey-level value.

It is possible to use a printhead structure according to this invention, in a DEP device comprising a segmented back electrode (105) as described in e.g. U.S. Pat. No. 5,036,341 or U.S. Pat. No. 5,121,144 and EP-A 708 386. The printhead structure of this invention can also be used with a single, not segmented back electrode, and also in DEP devices using a separate support for the image receiving member and a separate back electrode.

It is possible to implement a DEP device, using a printhead structure according to the present invention, wherein the charged toner particles are not first brought from a magnetic brush (104) to a charged toner conveyer (103), but wherein the toner particles are directly extracted from magnetic brush (104). In such a DEP device said toner delivery means (101) comprises a container for multi component developer (102), comprising magnetic carrier particles and toner particles, and a magnetic brush assembly (104) providing charged toner particles that are directly attracted to said image receiving substrate (109), through said printing apertures (107) from said magnetic brush assembly (104). Such a DEP device, extracting the toner particles directly from a magnetic brush has been described in e.g. Japanese Laid Open Publication 60/263962, U.S. Pat. No. 5,327,169 and EP-A 675 417.

In a DEP device according to a further embodiment of the present invention, said charged toner conveyor is a moving belt or a fixed belt comprising an electrode structure generating a corresponding electrostatic travelling wave pattern for moving the toner particles.

When in a DEP device, with a printhead structure according to this invention, the charged toner particles are directly attracted to said image receiving substrate (109), through said printing apertures (107) from said magnetic brush assembly (104), said magnetic brush can be either of the type with stationary core and rotating sleeve or of the type with rotating core and rotating or stationary sleeve.

When said magnetic brush assembly, used in a DEP device wherein the toner particles are brought to a charged toner conveyer as well as in a DEP device wherein the toner is directly attracted from the magnetic brush, is of the stationary core/rotating sleeve type said magnetic carrier particles are soft magnetic particles exhibiting a coercivity of less than 250 Oe (19.91 kA/m).

When said magnetic brush assembly, used in a DEP device wherein the toner particles are brought to a charged toner conveyer as well as in a DEP device wherein the toner is directly attracted from the magnetic brush, is of the rotating core/rotating sleeve type said magnetic carrier particles are hard magnetic particles exhibiting a coercivity of more than 250 Oe (19.91 kA/m).

In the embodiment using a multi-component development system several types of carrier particles, such as described in the EP-A 675 417 can be used.

Also toner particles suitable for use in the present invention are described in the above mentioned EP-A 675 417. Very suitable toner particles, for use in combination with a printhead structure according to the present invention are toner particles, having a well defined degree of roundness. Such toner particles have been described in detail in EP-A 715 218, that is incorporated herein by reference.

The usefulness of a printhead structure, according to the present invention, is not restricted to DEP devices working with multi-component developer. A printhead structure according to the present invention is also useful in devices using magnetic mono-component toners, non magnetic mono-component toners, etc.

A DEP device making use of the above mentioned marking toner particles can be addressed in a way that enables it to give black and white. It can thus be operated in a "binary way", useful for black and white text and graphics and useful for classical bilevel halftoning to render continuous tone images.

A DEP device according to the present invention is especially suited for rendering an image with a plurality of grey levels. Grey level printing can be controlled by either an amplitude modulation of the voltage $V_3$ applied on the control electrode (106*a*) or by a time modulation of $V_3$. By changing the duty cycle of the time modulation at a specific frequency, it is possible to print accurately fine differences in grey levels. It is also possible to control the grey level printing by a combination of an amplitude modulation and a time modulation of the voltage $V_3$, applied on the control electrode.

Multilevel halftoning techniques, such as e.g. described in the EP-A 634 862 can be used for a printhead according to the present invention. This enables the DEP device, according to the present invention, to render high quality images.

Several DEP devices, incorporating printhead structures of the present invention, (each having a toner with a different colour) can, as is the case with any DEP device or in fact with any printing device (e.g. ink-jet printing devices, modules applying toner to an electrostatic latent image, etc), be combined in a single apparatus, making it possible to obtain a colour-printer yielding high quality images. DEP devices can be incorporated in such a single apparatus in line, in a circle, etc in the vicinity of an image receiving substrate in such a way that colour images are applied in register to said substrate. DEP devices can be ordered along to sides of a web of image receiving substrate in such a way that on both sides of said image receiving substrate colour images are formed in register in one pass. A possible embodiment of positioning DEP devices in the vicinity of an image receiving member can be derived from e.g. U.S. Pat. No. 5,173,735 directed to electrophotography. It is possible to replace the toner applying modules by DEP devices and the electrophotosensitive drum by an intermediate image receiving substrate. Printing of colour images with very good register quality can be achieved with e.g. register control means comprising an encoder driven by the displacement of the image receiving substrate (in web form). The encoder can e.g. be mounted on one of the rotating intermediate image receiving members. This encoder produces pulses indicative of the web displacement. By this means that the moving web can accurately be synchronized with rotating intermediate image receiving members on which the separate colour images (the colour separations yellow, magenta, cyan and optionally black) are applied by different DEP devices. It is also possible to use different DEP devices that deposit toner images directly to an image receiving substrate in web form. In that case the web velocity is accurately registered with auxiliary devices. Embodiments of colour printing apparatus, printing on material (substrates) in web form and using register control means, are disclosed in e.g. EP-A 629 924, EP-A 629 927 and EP 631 204. The apparatus, disclosed in the documents cited above, are designed as classical electrophotographic apparatus, but can be changed to printing apparatus using DEP devices. The colour printing using different DEP devices, can proceed on image receiving substrates in web or sheet form. A colour printing apparatus using registering means and printing on sheet material is e.g. disclosed in U.S. Pat. No. 5,119,128.

The combination of a final image receiving substrate in web form, accurate registration of colour separations, measurement of web velocity and changes in web velocity, the placement of several DEP devices (several DEP devices can be placed in such a way that printing on both sides of the web in one pass is possible) open the way for colour printing devices based on DEP (direct electrostatic printing) using receiving members in web form. After printing the web can be wound up again or can immediately after printing be cut into sheets. In this way colour printing apparatus, based upon a DEP technique, with very good image quality can be made. These apparatus can be adapted for printing of very small items (e.g. ID-cards, security printing, etc) as well as for printing very large surfaces (e.g. poster or sign printing).

It can be advantageous to combine a DEP device, according to the present invention, in one apparatus together with a classical electrographic or electrophotographic device, in which a latent electrostatic image on a charge retentive surface is developed by a suitable material to make the latent image visible. In such an apparatus, the DEP device according to the present invention and the classical electrographic device are two different printing devices. Both may print images with various grey levels and alphanumeric symbols and/or lines on one sheet or substrate. In such an apparatus the DEP device according to the present invention can be used to print fine tuned grey levels (e.g. pictures, photographs, medical images etc. that contain fine grey levels) and the classical electrographic device can be used to print alphanumeric symbols, line work etc. Such graphics do not need the fine tuning of grey levels. In such an apparatus—combining a DEP device, according to the invention with a classical electrographic device—the strengths of both printing methods are combined.

EXAMPLES

The DEP device used throughout the examples

In each example the same DEP device, using the same toner particles and carrier particles were used. Only the printhead structure and the orientation thereof were changed.

The toner delivery means was a charged toner conveyor supplied with charged toner particles from a stationary core/rotating sleeve type magnetic brush. The development assembly comprised two mixing rods and one metering roller. One rod was used to transport the developer through the unit, the other one to mix toner with developer.

The magnetic brush assembly (104) was constituted of the so called magnetic roller, which in this case contained inside the roller assembly a stationary magnetic core, showing nine magnetic poles of 500 Gauss magnetic field intensity and with an open position to enable used developer to fall off from the magnetic roller. The magnetic roller contained also a sleeve, fitting around said stationary magnetic core, and giving to the magnetic brush assembly an overall diameter of 20 mm. The sleeve was made of stainless steel roughened with a fine grain to assist in transport (Ra=3 μm).

A scraper blade was used to force developer to leave the magnetic roller. And on the other side a doctoring blade was used to meter a small amount of developer onto the surface of said magnetic brush assembly. The sleeve was rotating at 100 rpm, the internal elements rotating at such a speed as to conform to a good internal transport within the development unit. The magnetic brush assembly (104) was connected to a DC-power supply with −200V (this is the $V_2$, referred to herein above in the description of FIG. 3).

Said magnetic brush was located at 650 micron from the surface of a teflon coated aluminium charged toner conveyor (103) with a diameter of 40 mm. The sleeve of said charged toner conveyor was connected to an AC power supply with a square wave oscillating field of 600 V at a frequency of 3.0 kHz with 10 V DC-offset (this 10 V DC are the $V_1$, referred to hereinabove in the description of FIG. 3).

The back electrode (105) was held at 600 V DC (this is $V_4$, referred to herein above in the description of FIG. 3).

A macroscopic "soft" ferrite carrier consisting of a MgZn-ferrite with average particle size 50 μm, a magnetisation at saturation of 29 emu/g was provided with a 1 μm thick acrylic coating. The material showed virtually no remanence.

The toner used for the experiment had the following composition: 97 parts of a co-polyester resin of fumaric acid and propoxylated bisphenol A, having an acid value of 18 and volume resistivity of $5.1\times10^{16}$ Ω.cm was melt-blended for 30 minutes at 110° C. in a laboratory kneader with 3 parts of Cu-phthalocyanine pigment (Colour Index PB 15:3). A resistivity decreasing substance—having the following structural formula: $(CH_3)_3N^+C_{16}H_{33}Br^-$ was added in a quantity of 0.5% with respect to the binder. It was found that—by mixing with 5% of said ammonium salt—the volume resistivity of the applied binder resin was lowered to $5\times10^{14}$ Ω.cm. This proves a high resistivity decreasing capacity (reduction factor: 100).

After cooling, the solidified mass was pulverized and milled using an ALPINE Fliessbettgegenstrahlmühle type 100AFG (tradename) and further classified using an ALPINE multiplex zig-zag classifier type 100MZR (tradename). The resulting particle size distribution of the separated toner, measured by Coulter Counter model Multisizer (tradename), was found to be 6.3 μm average by number and 8.2 μm average by volume. In order to improve the flowability of the toner mass, the toner particles were mixed with 0.5% of hydrophobic colloidal silica particles (BET-value 130 $m^2/g$).

An electrostatographic developer was prepared by mixing said mixture of toner particles and colloidal silica in a 10% ratio by weight (w/w) with carrier particles.

The distance between the front side of the printhead structure (106) and the sleeve of the charged toner conveyor (103), was set at 400 μm. The distance between the surface of said charged toner conveyor (103) and the sleeve of the magnetic brush (104), was set at 650 μm. The distance between the support for the image receiving substrate (105) (in the example said support combines the supporting function with the function of back electrode) and the back side of the printhead structure (106) (i.e. control electrodes (106*a*)) was set to 150 μm and the paper travelled at 1 cm/sec.

Measurement of Printing Quality

A printout was made using the DEP configurations of the examples and comparative examples. The voltage applied to the control electrodes (this is $V_3$, referred to hereinabove in the description of FIG. 3) was varied from 0 V to −300 V. Both the resulting density and the line thickness for a single individual line in the print direction was measured.

The result are summarized in table 1. The voltage needed to block the image density is therein represented by VOLT (a value that is less negative is better, a value of <−500 has to be understood as a voltage more negative than −500 volt). The percentage change in line thickness at quarter density (at a quarter of the maximum density) by LINE (the higher the value the better, meaning that accurate printing is possible over the line width also when the density is only a quarter of the maximum density).

Example 1 (E1)

A printhead structure (106) was made from a polyimide film of 50 μm thickness, single sided coated with a 8 μm thick copper film. The printhead structure (106) had a plurality of apertures. On the front side of the printhead structure, facing the toner application module, a rectangular shaped control electrode (106*a*) was arranged around two rectangular shaped apertures. The rectangular shaped control electrode had a width of 920 micron in the print direction and 760 micron in the perpendicular direction, the rectangular shaped apertures had a width perpendicular to the printing direction (WL) of 600 micron and a width in the direction (WD) of 200 micron. The printhead structure had two rows of these control electrodes (each having two separate apertures) staggered with no overlap to obtain a resolution of 42 dpi. The resolutions for each printhead structure are tabulated in table 1 under the heading PITCH. Each of said control electrodes was individually addressable from a high voltage power supply.

The individually addressable control electrode structures were made by conventional techniques used in the microelectronics industry, using photoresist material, film exposure, and subsequent etching techniques. The apertures (107) were "drilled" by plasma etching techniques.

Comparative Example 1 (CE1)

The see print configuration as described in example 1 was used except that the printhead structure had only one aperture per control electrode, wherein the aperture had a square form with a width in both directions of 600 micrometer. The results of the printing experiments are also indicated in table 1.

Examples 2–5 (E2–E5)

The same print configuration as described in example 1 was used except that for the printhead structure the parameters concerning aperture width in both directions, pitch and overlap as given in table 1 were used. In example 5 the overlap of 100% indicates that instead of one set of two lines of control electrodes, two sets of 2 lines are used, so that in fact an overdetermined (redundant) system is obtained, having the advantage that an image pixel can be written from different individual apertures so that a small deviation in one of the apertures (e.g. variability in aperture diameter) is not seen too much in the printout. This implementation enhances clearly the overall quality. The results of the printing experiments are also indicated in table 1.

Comparative Example 2 (CE2)

A printhead structure with the same layout as described in comparative example 1 was used except that the width of the aperture and the pitch was changed. The results of the printing experiments with this comparative printhead structure are also gathered in table 1.

TABLE 1

| N° | WL* | WD** | WE+ | AR*** | L† % | PITCH in dpi†† | VOLT | LINE % |
|---|---|---|---|---|---|---|---|---|
| E1 | 600 | 200 | 200 | 3.0 | 0 | 42 | −250 | 95% |
| CE1 | 600 | 600 | 0 | 1.0 | 0 | 42 | <−500 | 35% |
| E2 | 600 | 125 | 350 | 4.8 | 20 | 53 | −170 | 98% |
| E3 | 400 | 125 | 150 | 3.2 | 20 | 79 | −170 | 90% |
| E4 | 400 | 150 | 130 | 2.7 | 20 | 79 | −200 | 80% |
| CE2 | 400 | 400 | 0 | 1.0 | 20 | 79 | <−500 | 40% |
| E5 | 600 | 125 | 350 | 4.8 | 100 | 42 | −170 | 98% |

*the long axis WL of the aperture in μm

**the width of the aperture in a direction perpendicular to this long axis in μm (the short axis WD)

+width of the portion of the control electrode separating the printing apertures

***aspect ratio = WL/WD

†L = overlap as a percentage of WL

††possible resolution in dots per inch, (100 dots per inch = 40 dots per cm)

VOLT: the voltage necessary to block the printing aperture, the less negative the better, <−500 V means a voltage that is more negative than −500 V.

LINE: the % of the intended line thickness at a quarter of the maximum density.

From the data in table 1 it is evident that only the printhead structures according to the present invention can completely block the image density at voltage levels higher than −300 V (i.e. less negative than) and that the line thickness in the printing direction is nearly constant, irrespective of the image density. This last criterium indicates that the overall evenness of the image remains constant in all density areas.

I claim:

1. A printhead structure for use in a DEP (Direct Electrostatic Printing) device, made from an insulating material comprising control electrodes in combination with printing apertures, characterised in that:

(i) said printhead structure comprises individual control electrodes, each of said individual control electrodes controlling a plurality of i apertures, i being an integer larger than 1, (ii) each of said individual control electrodes is located on one side of said insulating material and (iii) each of said i apertures has a long axis $WL_j$ (j=1 . . . i) and a short axis $WD_j$ (j=1 . . . i) and an aspect ratio (AR), defined as $WL_j/WD_j$, larger than 1 and iv) i−1 portions of said control electrode, having width $WE_k$ (k=1 . . . (i−1)), separate each of said i apertures.

2. A printhead structure according to claim 1, wherein said apertures are rectangular.

3. A printhead structure according to claim 1, wherein $$\left(\sum_{j=1}^{i} WD_j + \sum_{k=1}^{(i-1)} WE_k\right) \leqq 1.20WL_{max},$$

when $WL_{max}$ is the largest of said long axis $WL_j$.

4. A printhead structure according to claim 1, wherein at least two rows of printing apertures are present and wherein said apertures in of different rows are staggered and have an overlap L/WL≧0.20.

5. A printhead structure according to claim 1, comprising at least two sets of rows of apertures, and said apertures in said sets of rows overlapping row by row for such that L/WL=1.

6. A printhead structure according to claim 1, wherein i equals 2.

7. A printhead structure according to claim 6, wherein said apertures are rectangular.

8. A printhead structure according to claim 6, wherein $$\left(\sum_{j=1}^{i} WD_j + \sum_{k=1}^{(i-1)} WE_k\right) \leqq 1.20WL_{max},$$

when $WL_{max}$ is the largest of said long axis $WL_j$.

9. A printhead structure according to claim 6, wherein at least two rows of printing apertures are present and wherein said apertures in of different rows are staggered and have an overlap L/WL≧0.20.

10. A printhead structure according to claim 6, comprising at least two sets of rows of apertures, and said apertures in said sets of rows overlapping row by row for such that L/WL=1.

* * * * *